US009494300B2

(12) United States Patent
Takayama et al.

(10) Patent No.: US 9,494,300 B2
(45) Date of Patent: Nov. 15, 2016

(54) ILLUMINATING APPARATUS

(71) Applicant: MINEBEA CO., LTD., Kitasaku-gun, Nagano (JP)

(72) Inventors: Ryohei Takayama, Fukuroi (JP); Hideki Kato, Hamamatsu (JP)

(73) Assignee: MINEBEA CO., LTD., Kitasaku-gun (JP)

( * ) Notice: Subject to any disclaimer, the term of this patent is extended or adjusted under 35 U.S.C. 154(b) by 215 days.

(21) Appl. No.: 14/543,329

(22) Filed: Nov. 17, 2014

(65) Prior Publication Data

US 2015/0176808 A1 Jun. 25, 2015

(30) Foreign Application Priority Data

Dec. 25, 2013 (JP) ..... 2013-267698

(51) Int. Cl.

| | |
|---|---|
| ***F21V 7/00*** | (2006.01) |
| ***F21V 13/04*** | (2006.01) |
| ***F21V 5/02*** | (2006.01) |
| ***F21V 5/00*** | (2015.01) |
| *F21Y 101/00* | (2016.01) |

(52) U.S. Cl.

CPC ..... *F21V 13/04* (2013.01); *F21V 5/005* (2013.01); *F21V 5/02* (2013.01); *F21V 7/0091* (2013.01); *F21Y 2101/00* (2013.01)

(58) Field of Classification Search

CPC ..... F21V 13/04; F21V 5/05; F21V 5/02; F21V 5/04

See application file for complete search history.

(56) References Cited

U.S. PATENT DOCUMENTS

| | | | | |
|---|---|---|---|---|
| 4,823,246 A * | 4/1989 | Dilouya | F21S 48/24 | 362/296.07 |
| 7,575,344 B2 * | 8/2009 | Lin | F21S 6/003 | 362/336 |
| 7,686,481 B1 * | 3/2010 | Condon | F21S 48/215 | 362/331 |
| 7,909,485 B2 * | 3/2011 | Chuang | G02B 5/189 | 362/311.01 |

FOREIGN PATENT DOCUMENTS

| | | |
|---|---|---|
| JP | A-9-27206 | 1/1997 |
| JP | A-2003-157708 | 5/2003 |
| JP | A-2004-247147 | 9/2004 |

* cited by examiner

*Primary Examiner* — Ali Alavi
(74) *Attorney, Agent, or Firm* — Oliff PLC

(57) ABSTRACT

An illuminating apparatus includes a light source and an optical member that is disposed in front of the light source and controls light distribution of light emitted from the light source. The optical member has a pair of principal surfaces, and a plurality of prisms extending in one direction are provided on at least one among the pair of principal surfaces. The plurality of prisms include a plurality of reflecting prisms that are provided in a first region A among two regions divided at a virtual plane including a reference axis and emit light entered upon reflecting it at a reflecting surface and a plurality of refracting prisms that are provided in a second region among the two regions and emit light entered upon refracting it at a refracting surface.

8 Claims, 7 Drawing Sheets

ILLUMINATING APPARATUS

BACKGROUND OF THE INVENTION

1. Field of the Invention

The present invention relates to an illuminating apparatus that has asymmetrical light distribution characteristics.

2. Description of the Related Art

An illuminating apparatus that has asymmetrical light distribution characteristics is conventionally used in a wall washer illuminating apparatus that is attached to a ceiling and illuminates a vertical wall surface.

As such an illuminating apparatus, an illuminating apparatus that realizes asymmetrical light distribution characteristics by disposing a plurality of LEDs with mutually different beam angles so that they are inclined relative to the vertical direction has been proposed (for example, refer to Japanese Patent Application Laid-Open (JP-A) No. 2004-247147).

Further, an illuminating apparatus that realizes asymmetrical light distribution characteristics by using louvers consisting of two types of panels with mutually different diffusivity and reflectivity to enable uniform illumination of a side wall surface at approximately the same brightness from the top (ceiling surface side) to the bottom (floor surface side) (for example, refer to Japanese Patent Application Laid-Open (JP-A) No. H9-27206), as well as an illuminating apparatus that realizes asymmetrical light distribution characteristics by using a reflecting panel that includes a main reflecting surface and an auxiliary reflecting surface that has an inclined surface whose inclination or curvature differs from that of the main reflecting surface to enable illumination of a wall surface and a floor surface (for example, refer to Japanese Patent Application Laid-Open (JP-A) No. 2003-157708) have also been proposed.

SUMMARY OF THE INVENTION

However, in all of the conventional illuminating apparatuses described above, there have been problems in that it is difficult to make the illuminating apparatus more compact or enhance the mass producibility due to the structure thereof.

The present invention was created in consideration of the above-described problems, and an object thereof is to provide an illuminating apparatus that realizes asymmetrical light distribution characteristics and is suitable for reductions in size and achieves superior mass producibility.

The embodiments of the invention described below are examples of the structure of the present invention. In order to facilitate the understanding of the various structures of the present invention, the explanations below are divided into aspects. Each aspect does not limit the technical scope of the present invention, and the technical scope of the present invention can also include structures in which a portion of the components in the aspects below is substituted or deleted, or another component is added upon referring to the best modes for carrying out the invention.

According to a first aspect of the present invention, an illuminating apparatus includes: a light source; and an optical member that faces the light source and controls light distribution of light emitted from the light source, wherein the optical member has a pair of principal surfaces, and a plurality of prisms extending in one direction are provided on at least one of the pair of principal surfaces, the plurality of prisms including: a plurality of reflecting prisms that are provided in a first region among two regions divided at a virtual plane including a reference axis, the reflecting prisms being configured to emit light entered while reflecting the light at a reflecting surface, and a plurality of refracting prisms that are provided in a second region among the two regions, the refracting prisms being configured to emit light entered while refracting the light at a refracting surface.

With this structure, asymmetrical light distribution characteristics can be efficiently realized based on the arrangement of the optical member to which the plurality of reflecting prisms and the plurality of refracting prisms are provided and the light source, the optical design of the plurality of prisms provided to the optical member, and the like. Further, the optical member can typically be made with a thin panel-shaped (sheet-shaped) member, and thus it is suited to reducing the size (particularly reducing the thickness) of the apparatus. Also, for example, the optical member can be molded by injection molding, and thus it has superior mass producibility.

Further, according to the first aspect of the present invention, in the illuminating apparatus, the plurality of reflecting prisms and the plurality of refracting prisms are overall configured to emit light entered by inclining the light in one direction relative to an optical axis of the light source.

With this structure, asymmetrical light distribution characteristics including a light distribution of a form in which the light is concentrated in one direction that differs from the optical axis direction of the light source can be realized.

Further, according to the first aspect of the present invention, in the illuminating apparatus, the refracting prisms are configured so that the refracting surfaces face the reference axis, and the reflecting prisms are configured so that the reflecting surfaces face the opposite side of the reference axis.

With this structure, by emitting light entered into the optical member from the light source so that it is inclined relative to the optical axis of the light source in a direction from a first region side toward a second region side, asymmetrical light distribution characteristics including a light distribution of a form in which the light is concentrated in the above-mentioned direction can be efficiently realized.

Further, according to the first aspect of the present invention, in the illuminating apparatus, the second region includes a region in which a plurality of the refracting prisms which are configured so that inclination angles of the refracting surfaces decrease as moving away from the reference axis are disposed.

With this structure, the occurrence of light that is not emitted in the forward direction of the optical member and becomes stray light can be suppressed.

Further, according to the first aspect of the present invention, in the illuminating apparatus, the light source is disposed so that its optical axis is included in the second region.

With this structure, by emitting light entered into the optical member from the light source so that it is inclined relative to the optical axis of the light source in a direction from a first region side toward a second region side, asymmetrical light distribution characteristics including a light distribution of a form in which the light is concentrated in the above-mentioned direction can be more efficiently realized.

Further, according to the first aspect of the present invention, in the illuminating apparatus, the plurality of prisms are provided on a principal surface of the optical member on the opposite side of a principal surface that faces the light source.

With this structure, compared to a case in which a plurality of prisms are provided on a principal surface of the optical member that faces the light source, the peak angle of light emitted so that it is inclined relative to the optical axis of the light source in a direction from a first region side toward a second region side can be increased without increasing the amount of light emitted in a direction that differs from that of the light emitted so that it is inclined relative to the optical axis of the light source in a direction from the first region side toward the second region side.

Further, according to the first aspect of the present invention, in the illuminating apparatus, a flat portion is provided between at least one prism among the plurality of prisms and at least one prism that is adjacent thereto.

With this structure, by combining a light distribution that is controlled by the plurality of prisms provided on the optical member with a light distribution of light emitted via the flat portion of the optical member, the illuminating apparatus can more flexibly adapt to various demands for light distribution characteristics of an illuminating apparatus.

With the structures described above, the present invention can provide an illuminating apparatus that realizes asymmetrical light distribution characteristics and is suitable for reductions in size and achieves superior mass producibility.

DETAILED DESCRIPTION

Figure 1:
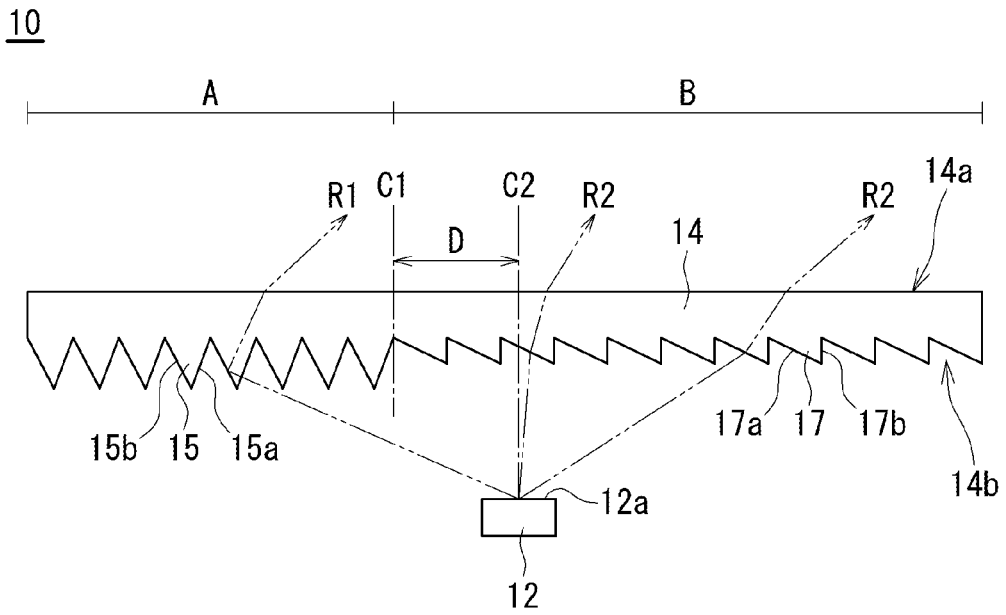
FIG. 1 is a side surface view illustrating the essential parts of an illuminating apparatus according to a first embodiment of the present invention.

An embodiment of the present invention will now be explained below referring to the drawings. The drawings (FIGS. 1, 4, 5, and 10) illustrating the structure of the illuminating apparatuses according to the present invention are all schematic views showing only the essential parts. Therefore, the illuminating apparatuses in the embodiments of the present invention can include other constituent elements omitted from the drawings such as a casing that retains the illustrated constituent elements therein. Further, the relative dimensions of each illustrated part exaggerate the characteristics for the sake of explanation, and do not necessarily reflect the actual scale.

An illuminating apparatus 10 according to a first embodiment of the present invention includes a light source 12 and an optical member 14 disposed opposing the light source 12. In this embodiment, the optical member 14 is a thin panel-shaped (sheet-shaped) member including two principal surfaces 14*a* and 14*b*. One principal surface 14*b* is disposed facing the light source 12. Also, in the illuminating apparatus 10, the optical member 14 is formed in an approximately rectangular shape in a plan view. However, in the present invention, the optical member 14 is not particularly limited by its outer shape as long as it includes a plurality of prisms 15 and 17 to be explained later.

With regard to the term "thin panel-shaped (sheet-shaped)" mentioned above, for example, compared to the similar terms "panel-shaped" and "film-shaped", it has generally been suggested that a panel, a thin panel (sheet), and a film exhibit decreasing thickness in that order. However, "thin panel-shaped (sheet-shaped)" is not always differentiated from terms such as "panel-shaped" and "film-shaped" based on a clear technical meaning with respect to, for example, a thickness in the presence or absence of flexibility. Thus, in the present invention, the term "thin panel-shaped (sheet-shaped)" is used as a term that can be appropriately substituted with terms such as "panel-shaped" and "film-shaped" in order to merely specifically indicate a shape that has two principal surfaces 14*a* and 14*b*.

Herein, in the illuminating apparatus 10, the direction from the light source 12 toward the optical member 14 is referred to as a "forward direction". In other words, the optical member 14 controls the light distribution of light emitted in the forward direction from the light source 12. Further, in the illuminating apparatus 10, the light source 12 is configured to emit light mainly in the forward direction. In addition, the light source 12 preferably emits light such that it spreads radially in the forward direction in at least a plane parallel to the paper surface in FIG. 1.

With regard to the light source 12, the axis indicated by reference numeral C2 in FIG. 1 is a reference axis of light distribution of the light source 12. This axis is normally established as a virtual axis that is perpendicular to a light-emitting surface of the light source 12 and passes through the photometric center (a point estimated as an origin point of light that disperses from the light source 12) (hereinafter, the axis C2 will also be referred to as an optical axis C2 of the light source 12). In the illustrated example, for the sake of explanation, the light-emitting surface of the light source 12 corresponds to a front surface 12*a* in terms of the outer shape of the light source 12, and the photometric center thereof is positioned at the geometric center of the light-emitting surface 12*a*. However, in the illuminating apparatus 10, the light source 12 includes cases in which the light-emitting surface is unclear as a top surface in the outer shape of the light source 12 or is a curved surface. In such cases, the light-emitting surface and the photometric center used in the definition of the optical axis C2 are respectively determined as an appropriate virtual surface and position considering the shape of the light source 12 and the like. In the following explanation, the light-emitting surface of the light source 12 is referred to using reference numeral 12*a* including the above-described cases. If the light source 12 has symmetrical light distribution around an axis perpendicular to the light-emitting surface 12*a*, the optical axis C2 is normally the axis of symmetry of this light distribution, and typically corresponds to the geometric center axis of the light-emitting surface 12*a*.

As will be explained below, the illuminating apparatus 10 controls the light distribution of light emitted from the light source 12 to a desired light distribution by the optical member 14, and emits light whose light distribution has been controlled in this way as illumination light. However, the illuminating apparatus 10 is configured such that the reference axis of the light distribution of the illumination light (the optical axis of the illuminating apparatus 10) coincides with the optical axis C2 of the light source 12.

The optical member 14 includes a reference axis C1 that is a virtual axis that serves as a reference for arranging the plurality of prisms. The plurality of prisms 15 and 17 are provided on the principal surface (also referred to as an "underside surface") 14*b* of the optical member 14 that faces the light source 12 based on the reference axis C1 as explained below.

The plurality of prisms 15 and 17 that extend in one direction (the direction orthogonal to the paper surface in FIG. 1) are provided on the underside surface 14*b* of the optical member 14 in regions on both sides when divided at a virtual plane (not illustrated; hereinafter also referred to as a "reference plane") including the reference axis C1. In FIG. 1, the reference plane is a virtual plane that includes the reference axis C1 and is orthogonal to the paper surface, and the plurality of prisms 15 and 17 extending parallel to the reference plane are aligned on the principal surface 14*b* of the optical member 14 in a direction that is orthogonal to the direction in which the prisms 15 and 17 extend.

Furthermore, the plurality of prisms 15 and 17 include reflecting prisms 15 that are provided in a first region A (a region on the left side of the reference axis C1 in FIG. 1) among the two regions divided at the reference plane, and refracting prisms 17 that are provided in a second region B (a region on the right side of the reference axis C1 in FIG. 1) among the two regions divided at the reference plane.

Hereinafter, the direction in which the plurality of prisms 15 and 17 extend (the direction orthogonal to the paper surface in FIG. 1) will be referred to as a longitudinal direction, and the arrangement direction of the plurality of prisms 15 and 17 (the left-right direction on the paper surface in FIG. 1) will be referred to as a transverse direction. The cross-section along a longitudinal direction and the cross-section along a transverse direction of the optical member 14 will be respectively referred to as the longitudinal cross-section and the transverse cross-section.

Each of the plurality of reflecting prisms 15 is a so-called TIR (Total Internal Reflection) prism. Specifically, each reflecting prism 15 includes a pair of prism surfaces 15*a* and 15*b* that are inclined relative to the principal surface (for example, an emitting surface 14*a*) of the optical member 14. Among the pair of prism surfaces 15*a* and 15*b*, a first surface 15*a* is arranged facing the reference axis C1 and a second surface 15*b* is arranged facing the opposite side of the reference axis C1.

Also, each of the plurality of refracting prisms 17 includes a pair of prism surfaces 17*a* and 17*b*, consisting of a first surface 17*a* that faces the reference axis C1 and a second surface 17*b* that faces the opposite side of the reference axis C1. Therein, the first surface 17*a* is arranged to be inclined relative to the principal surface (for example, the emitting surface 14*a*) of the optical member 14, whereas the second surface 17*b* which is connected to the first surface 17*a* of an adjacent refracting prism 17 is arranged approximately orthogonal to the principal surface of the optical member 14.

In the illuminating apparatus 10, the light source 12 is disposed such that its optical axis C2 is included in the second region B. In other words, based on the arrangement position of the light source 12, the reference axis C1 of the optical member 14 is set to a position that is shifted in the transverse direction relative to the optical axis C2 of the light source 12. Among the two regions when divided at the reference plane including the reference axis C1 arranged in this way, the plurality of reflecting prisms 15 are provided in the region (first region) A which does not include the optical axis C2 and the plurality of refracting prisms 17 are provided in the region (second region) B which includes the optical axis C2.

The optical member 14 normally has uniform optical characteristics in the longitudinal direction. In this case, the position of the reference axis C1 in the longitudinal direction can be set to any appropriate position in accordance with the specific structure of the illuminating apparatus 10, and does not necessarily have to coincide with the position of the optical axis C2 of the light source 12 in the longitudinal direction.

The light source 12 is typically arranged behind the center of the optical member 14 in a plan view based on the outer shape of the optical member 14. However, the present invention is not limited by the arrangement position of the light source 12 relative to the outer shape of the optical member 14 as long as the relative positional relationship between the reference axis C1 of the optical member 14 and the optical axis C2 of the light source 12 satisfies the above-described conditions.

Further, in the light illuminating apparatus 10, the light source 12 is preferably made of a point light source including a light-emitting diode. However, in the illuminating apparatus 10, the light source 12 can also be a linear light source. In this case, the light source 12 used in the illuminating apparatus 10 is arranged in the above-described predetermined position with regard to the light-emitting surface 12*a* and the optical axis C2, and is arranged such that the direction in which the linear light source 12 extends coincides with the direction in which the plurality of reflecting prisms 15 extend. Such a linear light source can include, for example, a straight tube-shaped fluorescent tube, or a plurality of point light sources that are arranged linearly.

Herein, in the illuminating apparatus 10, the plurality of reflecting prisms 15 and the plurality of the refracting prisms 17 are overall configured to emit light entered so that it is inclined in one direction (the right direction in the example shown in FIG. 1) relative to the optical axis C2 of the light source 12. This point will be explained in more detail below together with the operational effects of the illuminating apparatus 10.

In the following explanation, the transverse cross-section including the optical axis C2 of the light source 12 typically includes the reference axis C1. However, in a typical optical member 14 that has uniform optical characteristics in the longitudinal direction, light distribution control as explained below is also achieved in the case that the reference axis C1 is not included in the transverse cross-section including the optical axis C2 of the light source 12. In this case, the term "reference axis C1" in the following explanation can be replaced with the phrase "an axis established upon projecting the reference axis C1 in the longitudinal direction on the transverse cross-section including the optical axis C2 of the light source 12" (or "an intersection line of the reference plane and the transverse cross-section including the optical axis C2").

First, in the illuminating apparatus 10, the plurality of refracting prisms 17, each including the first surface 17*a* arranged to be inclined relative to the principal surface (for example, the emitting surface 14*a*) of the optical member 14 and the second surface 17*b* arranged to be approximately orthogonal to the principal surface of the optical member 14, are provided in the second region B of the underside surface 14*b* of the optical member 14. Therefore, most of the light that is emitted from the light source 12 and reaches the underside surface 14*b* in the second region B enters into the optical member 14 through the first surfaces 17*a* of the refracting prisms 17.

The first surface 17*a* of each refracting prism 17 is formed facing the reference axis C1. Thus, by appropriately setting the inclination angle thereof, light entered into the optical member 14 through the first surface (refracting surface) 17*a* is emitted from the emitting surface 14*a* so that it is inclined relative to the optical axis C2 in a direction from the first region A side toward the second region B side (refer to light paths R2 that are schematically illustrated in FIG. 1).

Figure 2A:
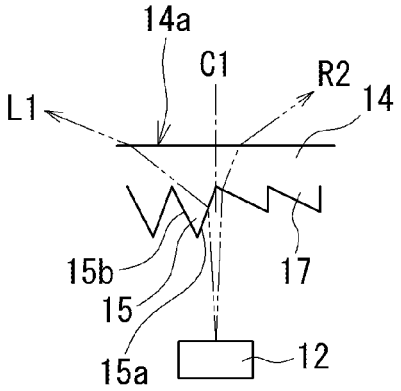
FIGS. 2A and 2B schematically illustrate examples of an optical path of light emitted from a light source for explaining a shift amount in the illuminating apparatus shown in FIG. 1.
Figure 2B:
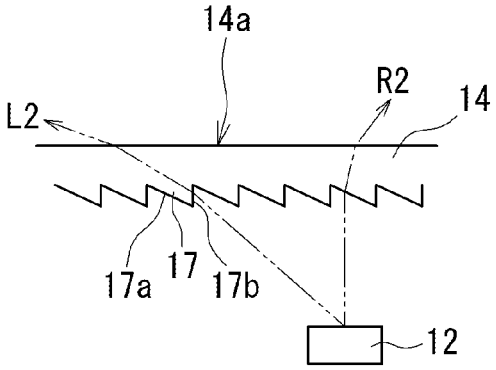

Herein, if all of the plurality of prisms 15 and 17 provided on the optical member 14 were configured as refracting prisms 17, it is understood that at least a portion of light that is emitted from the light source 12 so that it is rather significantly inclined relative to the optical axis C2 in a direction from the second region B side toward the first region A side (the left direction in the example shown in FIG. 1) and then enters into the refracting prisms 17 that are spaced away from the optical axis C2 would enter into the optical member 14 from the second surfaces 17*b* of such refracting prisms 17, and thus this portion of light would be emitted from the emitting surface 14*a* so that it is inclined relative to the optical axis C2 in a direction (the left direction in the example shown in FIG. 1) opposite to the light that enters from the first surfaces 17*a* as shown by a light path L2 in FIG. 2B.

However, in the illuminating apparatus 10, the plurality of reflecting prisms 15 are provided in the first region A on the underside surface 14*b* of the optical member 14. Therefore, light that is emitted from the light source 12 so that it is rather significantly inclined relative to the optical axis C2 in a direction from the second region B side toward the first region A side (the left direction in the example shown in FIG. 1) and then reaches the underside surface 14*b* in the first region A enters into the optical member 14 from the first surfaces 15*a* of the reflecting prims 15 which face the reference axis C1. At least a portion of this light is totally reflected at the second surfaces (reflecting surfaces) 15*b* which face the opposite side of the reference axis C1 and then proceeds into the optical member 14.

Therefore, by appropriately setting the inclination angles of the first and second surfaces 15*a* and 15*b* of the reflecting prisms 15, light that is reflected at the second surfaces (reflecting surfaces) 15*b* is emitted from the emitting surface 14*a* so that it is inclined relative to the optical axis C2 in a direction from the first region A side toward the second region B side (refer to the light path R1 that is schematically illustrated in FIG. 1).

In this way, according to the illuminating apparatus 10, the amount of light that is emitted so that it is inclined relative to the optical axis C2 in a direction from the first region A side toward the second region B side of the optical member 14 (hereinafter, also referred to as "primary light") can be increased relative to the amount of light that is emitted in another direction. In these terms, asymmetrical light distribution characteristics including a light distribution of a form in which the light is concentrated in one direction that differs from the optical axis C2 direction can be realized.

Herein, if the illuminating apparatus 10 is applied to a use in which the primary light is used as illumination light, the light that is emitted in another direction becomes lost light that is unnecessary in the illumination design.

With regard to this point, in the illuminating apparatus 10, by configuring the plurality of prisms 15 and 17 of the optical member 14 as composite prisms in which a plurality of reflecting prisms 15 are provided in a first region A and a plurality of refracting prisms 17 are provided in a second region B among the two regions divided at the reference plane instead of configuring all of the plurality of prisms 15 and 17 as refracting prisms 17, the amount of lost light as shown by the light path L2 in FIG. 2B can be reduced and the light distribution can be efficiently controlled.

Furthermore, for example, if the reference axis C1 is provided at a position at which the optical axis C2 of the light source 12 is included in the first region A, the amount of light that is emitted from the emitting surface 14*a* so that it is inclined relative to the optical axis C2 in a direction from the second region B side toward the first region A side (the left direction in the example shown in FIG. 1) will increase because light entered from the first surfaces 15*a* of the reflecting prisms 15 may proceed into the optical member 14 as is without being reflected at the second surfaces 15*b* as shown by a light path L1 in FIG. 2A. Light that is emitted from the light source 12 near the direction of the optical axis C2 is particularly likely to follow such an optical path. Since the region near the direction of the optical axis C2 is normally the range in which the amount of light is greatest among the light emitted from the light source 12, this is a significant factor leading to increases in lost light in an illumination design like that described above.

With regard to this point, in the illuminating apparatus 10, by providing the reference axis C1 at a position at which the optical axis C2 of the light source 12 is included in the second region B, the amount of lost light as shown by the light path L1 in FIG. 2A can be reduced and the light distribution can be efficiently controlled.

However, even if the optical axis C2 is included in the second region B, if the distance between the reference axis C1 and the optical axis C2 (a shift amount D) is small, the amount of lost light as shown by the light path L1 in FIG. 2A will increase. On the other hand, if the shift amount D is large, the amount of lost light as shown by the light path L2 in FIG. 2B will increase. Therefore, in the illuminating apparatus 10, the shift amount D is set to an appropriate value taking into consideration the following conditions: the size of the optical member 14 and the prisms 15 and 17, the surface area of the light-emitting surface 12*a* of the light source 12, the distance between the light source 12 and the optical member 14, and so on. For example, if the transverse width of the optical member 14 is 50 mm, an appropriate value for the shift amount D is 2 mm (if the transverse width of each of the prisms 15 and 17 is 50 μm, then there would be 40 prisms 15 and 17).

If the illuminating apparatus 10 is applied to a use in which the primary light is used as illumination light, the light emitted from the optical member 14 can include not only the primary light but also light emitted in another direction as long as the amount of the primary light is large enough compared to the amount of lost light emitted in another direction not to cause any practical problems. From this perspective, in the present invention, the feature in which the plurality of reflecting prisms 15 and the plurality of refracting prisms 17 are overall configured such that light that enters therein is emitted so that it is inclined in one direction relative to the optical axis C2 of the light source 12 can include cases in which light that is emitted in another direction from the optical member 14 is included.

Figure 3:
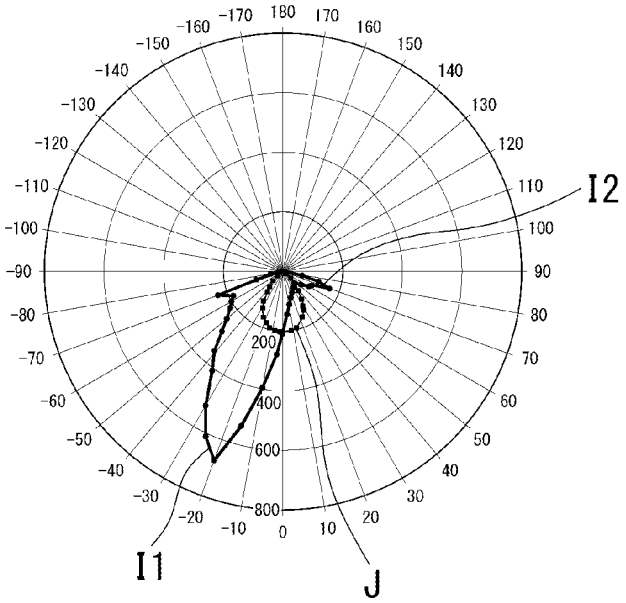
FIG. 3 is a graph illustrating light distribution characteristics of the illuminating apparatus shown in FIG. 1.

FIG. 3 illustrates the results upon analyzing (simulation by ray tracing) the light distribution of emitted light in a model corresponding to the illuminating apparatus 10. In the model used for this analysis, the refractive index of the optical member 14 was 1.58 (assuming a polycarbonate is used as the molding material), and the transverse width of the optical member 14 was 50 mm. The transverse width (and arrangement pitch) of the prisms 15 and 17 was 50 μm. The shift amount D between the optical axis C2 of the light source 12 and the reference axis C1 in the transverse cross-section including the optical axis C2 was 2 mm.

In FIG. 3, the coordinates in the circumferential direction indicate an angle of beam spread [°] when the optical axis C2 direction (forward direction) is 0°, and a negative angle corresponds to a tilt angle toward the right direction relative to the optical axis C2 direction in FIG. 1, whereas a positive angle corresponds to a tilt angle toward the left direction relative to the optical axis C2 direction in FIG. 1. The coordinates in the radial direction indicate a light intensity [cd]. In FIG. 3, light distribution curves in the transverse cross-section including the optical axis C2 are illustrated by the thick solid lines I1 and I2, and a light distribution curve in the longitudinal cross-section including the optical axis C2 is illustrated by the thin solid line J.

From the light distribution curves I1 and I2 in FIG. 3, it can be understood that in the illuminating apparatus 10, good asymmetrical light distribution (asymmetrical light distribution relative to the optical axis C2) is realized, and this asymmetrical light distribution includes a light distribution of a form in which the light is concentrated in one direction that differs from the optical axis C2 direction (corresponding to the light distribution curve I1), which constitutes the light distribution of the primary light, and has a small amount of lost light (corresponding to the light distribution curve I2). In the light distribution curve I1 of the primary light, the absolute value of the angle of beam spread at peak light intensity (also referred to as the "peak angle") is 20°.

From the light distribution curve J in FIG. 3, it can be understood that the light distribution in the longitudinal cross-section including the optical axis C2 is approximately symmetrical relative to the optical axis C2.

Herein, in the illuminating apparatus 10, the inclination angles of the second surfaces (reflecting surfaces) 15*b* of the plurality of reflecting prisms 15 and the inclination angles of the first surfaces (refracting surfaces) 17*a* of the plurality of refracting prisms 17 are appropriately set in accordance with the desired specifications of the light distribution characteristics of the illuminating apparatus 10.

For example, the inclination angles of the first surfaces (refracting surfaces) 17*a* of the plurality of refracting prisms 17 can all be the same. In this case, a relatively wide half-value width can be obtained for the light distribution of the primary light.

However, in this case, light that is refracted at a first surface (refracting surface) 17*a* and then enters into the optical member 14 is inclined more significantly relative to the optical axis C2 before proceeding the farther away the refracting prism 17 it enters is spaced from the optical axis C2. Therefore, there are cases in which light is totally reflected at the emitting surface 14*a* of the optical member 14 because it enters into the emitting surface 14*a* at an angle that is larger than a critical angle. This kind of light is not emitted in the forward direction from the emitting surface 14*a*, but rather is emitted from an unexpected location of the optical member 14 to become stray light, and this may lead to deterioration in the illumination quality.

Figure 4:
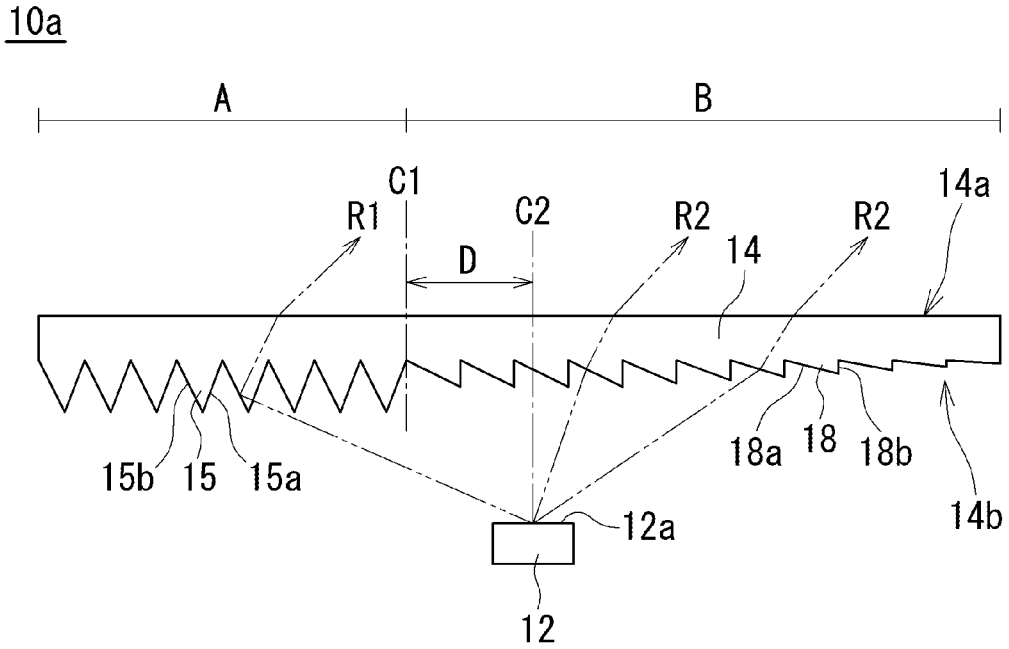
FIG. 4 is a side surface view illustrating an alternative embodiment of the illuminating apparatus according to the first embodiment of the present invention.

Therefore, in the illuminating apparatus 10, when the suppression of stray light is regarded as important, a plurality of refracting prisms 18 can be configured such that the inclination angle of a first surface (refracting surface) 18*a* of each prism 18 decreases (approaches an angle that is parallel to the emitting surface 14*a*) the farther away from the optical axis C2 the prism 18 is spaced, as shown in an illuminating apparatus 10*a* shown in FIG. 4. In this case, by appropriately setting the inclination angles of the first surfaces 18*a*, the half-value width of the light distribution of the primary light can be decreased.

Also, in the illuminating apparatus 10, the inclination angles of the second surfaces (reflecting surfaces) 15*b* of the plurality of reflecting prisms 15 can be randomly changed in order to, for example, improve color unevenness of the illumination light.

As explained above, according to the illuminating apparatus 10, asymmetrical light distribution characteristics can be efficiently realized based on the arrangement of the optical member 14 on which the plurality of reflecting prisms 15 and the plurality of refracting prisms 17 and 18 are provided and the light source 12, the optical design of the plurality of prisms 15, 17, and 18 provided on the optical member 14, and the like. Further, since the optical member 14 is made with a thin panel-shaped (sheet-shaped) member, it is suited to reducing the size (particularly reducing the thickness) of the apparatus. Also, since the plurality of prisms 15, 17, and 18 can be integrally molded by injection molding from a resin material used for optical uses such as, for example, a polycarbonate resin, the optical member 14 has superior mass producibility.

Also, the illuminating apparatus 10 is suitably used as a wall washer illuminating apparatus that is attached to a ceiling with the optical axis C2 direction as the vertical direction and illuminates a vertical wall surface that exists in a direction from the first region A side toward the second region B side of the optical member 14 with the primary light.

Next, referring to FIGS. 5 to 10, alternative embodiments of the illuminating apparatus of the present invention will be explained. In the explanation of the following embodiments, explanations of features that are the same as those in the previously explained embodiment(s) will be appropriately omitted, and the explanations will focus mainly on the unique features of each embodiment.

Figure 5:
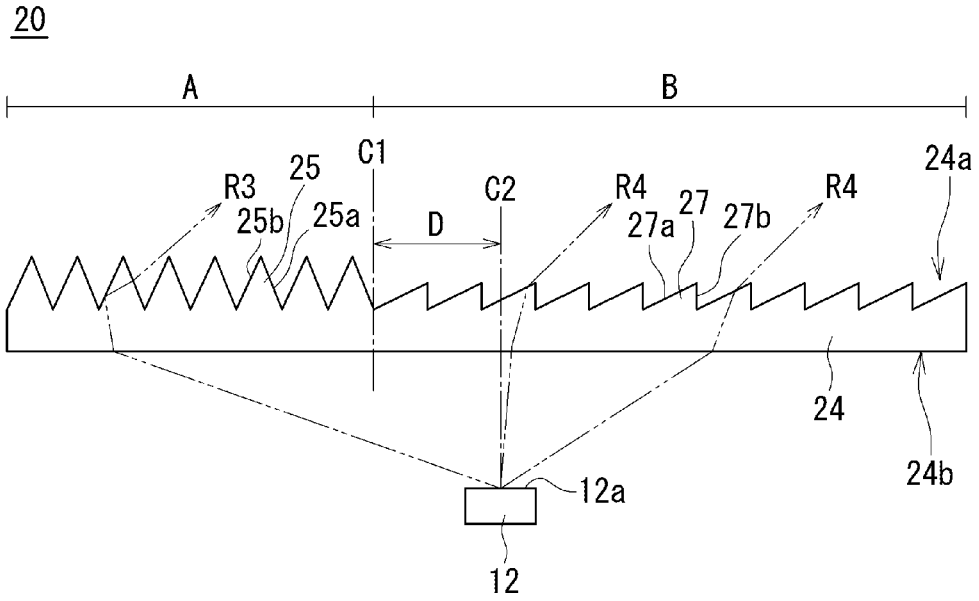
FIG. 5 is a side surface view illustrating the essential parts of an illuminating apparatus according to a second embodiment of the present invention.

An illuminating apparatus 20 according to a second embodiment of the present invention as shown in FIG. 5 differs from the illuminating apparatus 10 shown in FIG. 1 in that a plurality of reflecting prisms 25 and a plurality of refracting prisms 27 are provided on a surface of an optical member 24 on the opposite side of a surface 24*b* that faces the light source 12 (in other words, they are provided on an emitting surface 24*a*). Therefore, in the illuminating apparatus 20, light R3 that is emitted from the first region A of the optical member 24 is reflected at a second surface (reflecting surface) 25*b* of a reflecting prism 25 and then is emitted through a first surface 25*a* so that it is inclined relative to the optical axis C2 in a direction from the first region A side toward the second region B side of the optical member 24. Also, light R4 that is emitted from the second region B of the optical member 24 is refracted at a first surface (refracting surface) 27*a* of a refracting prism 27 and then is emitted so that it is inclined relative to the optical axis C2 in a direction from the first region A side toward the second region B side of the optical member 24.

The illuminating apparatus 20 constituted as described above achieves operational effects similar to those of the illuminating apparatus 10. In particular, the light source 12 is arranged so that its optical axis C2 is included in the second region B in the illuminating apparatus 20 as well, and the reference axis C1 of the optical member 24 is set at a position that is shifted in the transverse direction from the optical axis C2 of the light source 12 by an appropriate shift amount D. Therefore, lost light (in this case, particularly lost light in the first region A) can be reduced and the light distribution can be efficiently controlled. Further, similar to the illuminating apparatus 10, the inclination angles of the second surfaces 25*b* of the reflecting prisms 25 and the first surfaces 27*a* of the refracting prisms 27 can be regularly or randomly changed according to the distance from the optical axis C2 in accordance with the desired specifications for the light distribution characteristics or the desired specifications for color unevenness.

In addition, in the present invention, the top surface and underside surface of the optical member 14 used in the illuminating apparatus 10 can be inverted and applied as the optical member 24 of the illuminating apparatus 20. However, the light distribution characteristics of the illuminating apparatus 20 obtained in this case generally differ from the light distribution characteristics of the illuminating apparatus 10. Therefore, by utilizing this feature, in the present invention, two different light distribution characteristics can be realized using the optical members 14 and 24 which are substantially the same. Conversely, due to this feature, in the illuminating apparatus 20, it is necessary to configure the plurality of reflecting prisms 25 and the plurality of refracting prisms 27 to be different from the plurality of reflecting prisms 15 and the plurality of refracting prisms 17 of the illuminating apparatus 10 in order to realize the same light distribution characteristics as those of the illuminating apparatus 10. In particular, in order to make the peak angle of the illumination light match that of the illuminating apparatus 10, the inclination angles of the second surfaces (reflecting surfaces) 25*b* of the reflecting prisms 25 must be made smaller than the inclination angles of the second surfaces (reflecting surfaces) 15*b* of the reflecting prisms 15 of the illuminating apparatus 10.

In relation to this point, the illuminating apparatus 20 achieves an effect in that it can increase the peak angle of the illumination light compared to the illuminating apparatus 10 without increasing the amount of lost light. This effect will be explained below referring to FIGS. 6 to 8.

Figure 6A:
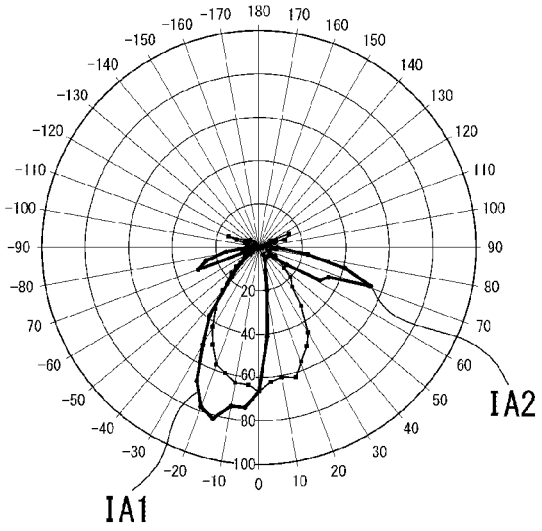
FIG. 6A, FIG. 6B and FIG. 6C show graphs illustrating the light distribution characteristics when a peak angle of primary light is set near 20° in the illuminating apparatus shown in FIG. 1, and FIGS. 6A, 6B, and 6C respectively illustrate the light distribution characteristics in a first region, in a second region, and across the entire optical member.
Figure 6B:
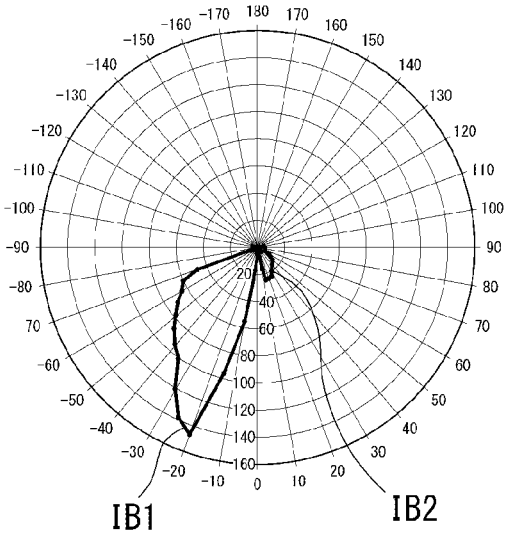
Figure 6C:
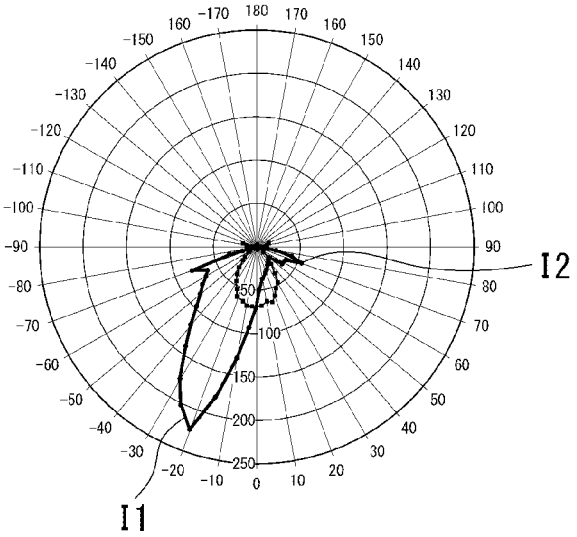
Figure 7A:
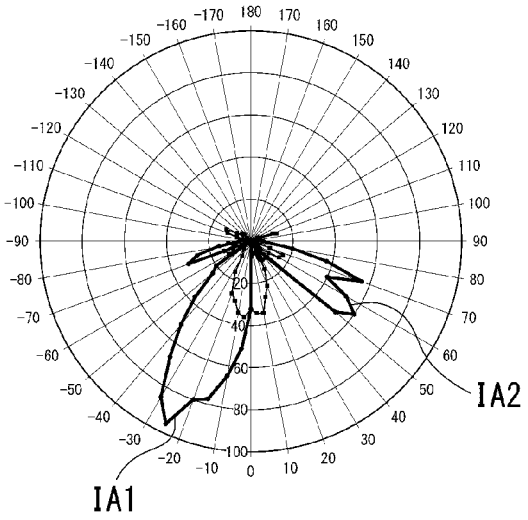
FIG. 7A, FIG. 7B and FIG. 7C show graphs illustrating the light distribution characteristics when the peak angle of the primary light is set to 25° or more in the illuminating apparatus shown in FIG. 1, and FIGS. 7A, 7B, and 7C respectively illustrate the light distribution characteristics in a first region, in a second region, and across the entire optical member.
Figure 7B:
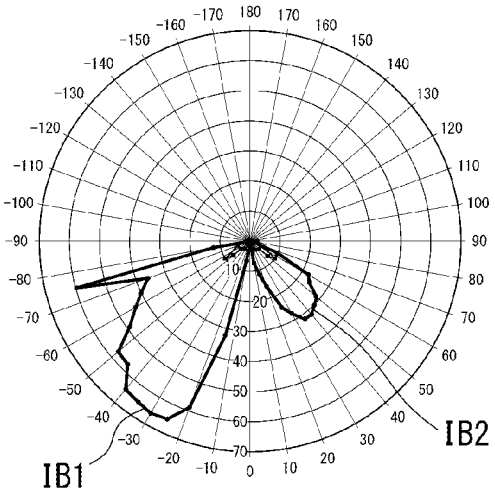
Figure 7C:
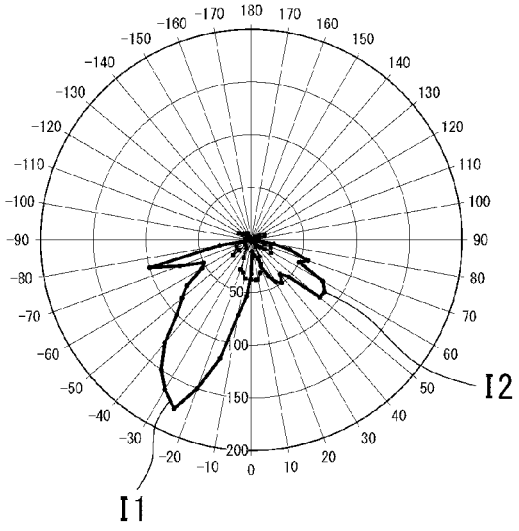
Figure 8A:
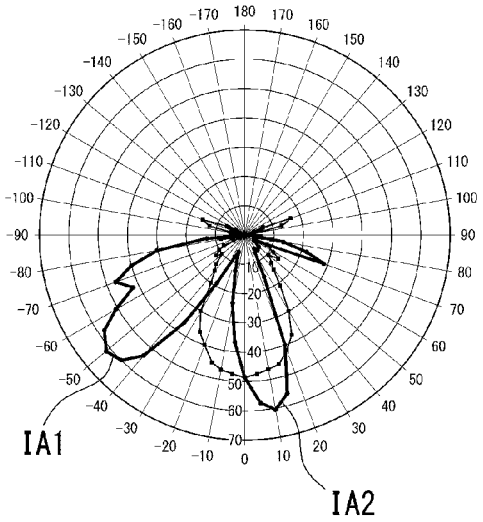
FIG. 8A, FIG. 8B and FIG. 8C show graphs illustrating the light distribution characteristics in the illuminating apparatus shown in FIG. 5, and FIGS. 8A, 8B, and 8C respectively illustrate the light distribution characteristics in a first region, in a second region, and across the entire optical member.
Figure 8B:
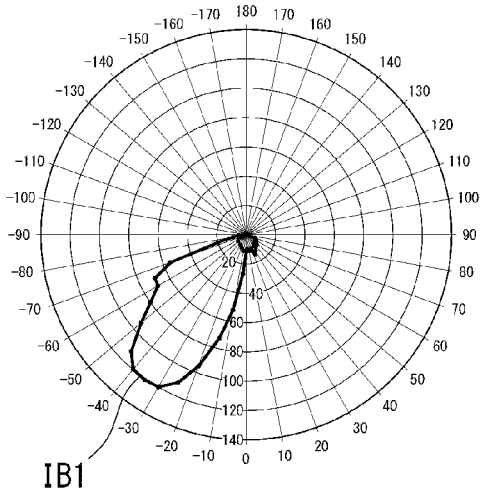
Figure 8C:
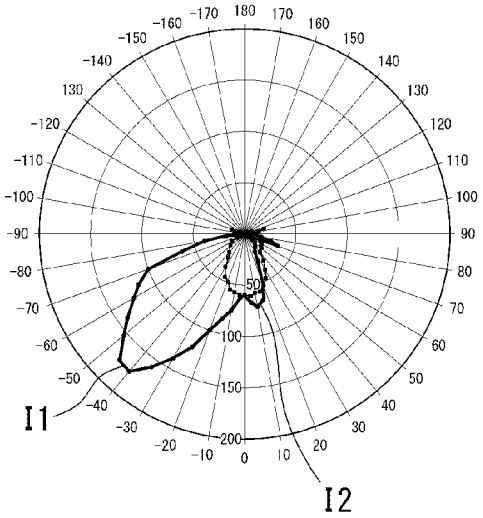

FIG. 6 shows graphs similar to those of FIG. 3 illustrating the light distribution characteristics when the peak angle of the primary light is set near 20° in the illuminating apparatus 10, and FIGS. 6A, 6B, and 6C respectively illustrate the light distribution characteristics in the first region A, in the second region B, and across the entire optical member 14. FIG. 7 shows graphs similar to those of FIG. 3 illustrating the light distribution characteristics when the peak angle of the primary light is set to 25° or more in the illuminating apparatus 10, and FIGS. 7A, 7B, and 7C respectively illustrate the light distribution characteristics in the first region A, in the second region B, and across the entire optical member 14. FIG. 8 shows graphs similar to those of FIG. 3 illustrating the light distribution characteristics in the illuminating apparatus 20, and FIGS. 8A, 8B, and 8C respectively illustrate the light distribution characteristics in the first region A, in the second region B, and across the entire optical member 24.

In these simulations, in order to increase the peak angle of the primary light of the illuminating apparatus 10, the inclination angles of the second surfaces (reflecting surfaces) 15*b* of the reflecting prisms 15 and the inclination angles of the first surfaces (refracting surfaces) 17*a* of the refracting prisms 17 were increased (to angles approaching parallel to the optical axis C2). However, the apex angles of the reflecting prisms 15 were the same (for example, 40°).

In the simulation showing the results in FIG. 8, the top surface and underside surface of the optical member 14 of the illuminating apparatus 10 corresponding to the simulation showing the results in FIG. 6 were inverted and this was used as the optical member 24 of the illuminating apparatus 20.

Comparing FIG. 6 and FIG. 7, it can be understood that in the illuminating apparatus 10, if the peak angle of the primary light is increased (refer to a light distribution curve I1 in FIG. 6C and a light distribution curve I1 in FIG. 7C), the amount of lost light increases in both the first region A and the second region B (refer to light distribution curves IA2 and IB2 in FIGS. 6A and 6B and light distribution curves IA2 and IB2 in FIGS. 7A and 7B). As a result, the overall amount of light loss increases (refer to a light distribution curve I2 in FIG. 6C and a light distribution curve I2 in FIG. 7C).

In contrast, comparing the light distribution curves I1 and I2 in FIG. 7C and a light distribution curves I1 and I2 in FIG. 8C, it can be understood that in the illuminating apparatus 20, the amount of lost light (corresponding to the light distribution curve I2) can be suppressed and the peak angle of the primary light (corresponding to the light distribution curve I1) can be increased to 40° or more.

It is believed that the amount of lost light in the illuminating apparatus 20 is low for the following reasons. In the illuminating apparatus 10, if the peak angle is increased by the above-described design modification of the reflecting prisms 15 and the refracting prisms 17, for example, there is an increase in the amount of lost light that enters from the first surface 15*a* of a reflecting prism 15 and then is emitted from the emitting surface 14*a* so that it is inclined in the left direction in FIG. 1 without entering the second surface 15*b* as shown by the light path L1 in FIG. 2A, as well as the amount of lost light (not illustrated) that enters from the first surface 17*a* of a refracting prism 17 and then is emitted from the emitting surface 14*a* so that it is inclined in the left direction in FIG. 1 without being reflected at the second surface 17*b*. In contrast, there is no such increase in these kinds of lost light in the illuminating apparatus 20 using the optical member 24.

With regard to the other features, from FIGS. 8A and 8B, it can be understood that the peak angle of the primary light increases in both the first region A and the second region B, and the increase is particularly remarkable in the first region A. Also, in the first region A, it can be understood that the lost light (corresponding to a light distribution curve IA2) includes light emitted in an approximately vertical direction (an angle of beam spread of about 10°) in addition to the very small amount of light that is emitted in the left direction at a large angle of beam spread (about 70°).

Figure 9:
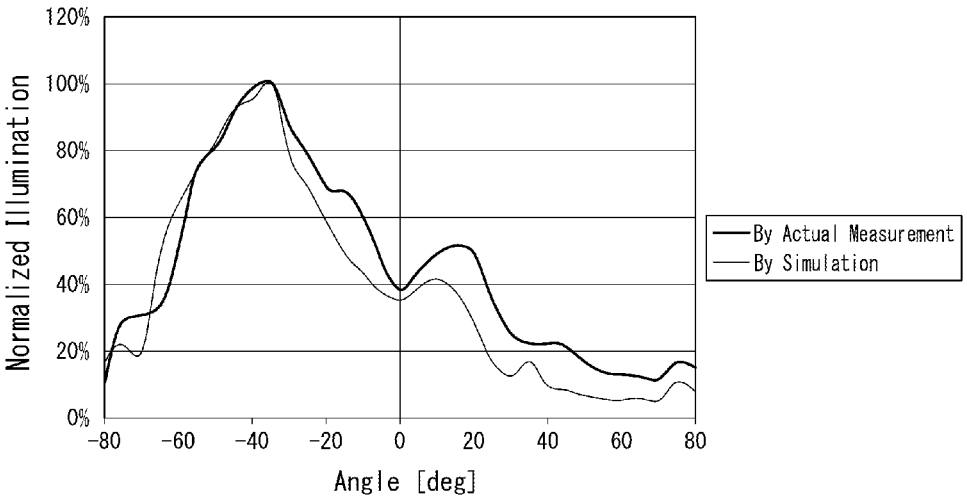
FIG. 9 is a graph comparing analysis results by simulation and measurement results using an actual sample device of the light distribution characteristics of the illuminating apparatus shown in FIG. 5.

FIG. 9 is a graph comparing analysis results by simulation and measurement results using an actual sample device of the light distribution characteristics of the illuminating apparatus 20. In FIG. 9, the light distribution characteristics of the illuminating apparatus 20 are illustrated with an illuminance distribution in which the illuminance measured at a predetermined location is normalized when the maximum illuminance is 100%. From FIG. 9, it can be understood that the analysis results and the measurement results match well.

Figure 10:
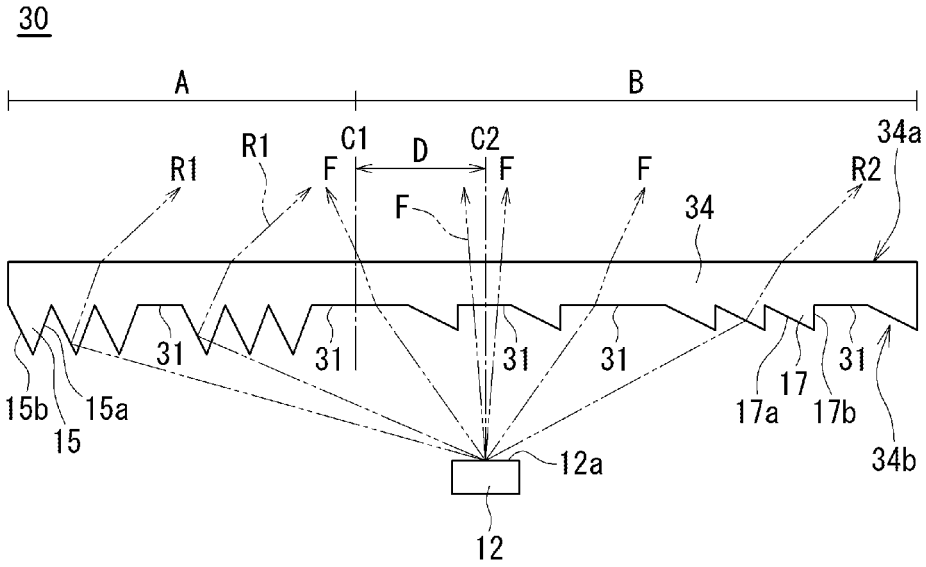
FIG. 10 is a side surface view illustrating the essential parts of an illuminating apparatus according to a third embodiment of the present invention.

An illuminating apparatus 30 according to a third embodiment of the present invention as shown in FIG. 10 differs from the illuminating apparatus 10 in that flat portions 31 are provided on an underside surface 34*b* of an optical member 34 on which the plurality of prisms 15 and 17 are provided. In the illuminating apparatus 30, the flat portions 31 are constituted by surfaces that are substantially parallel to an emitting surface 34*a*.

In the illuminating apparatus 30, operational effects similar to those of the illuminating apparatus 10 are achieved by controlling the light distribution with the plurality of reflecting prisms 15 and the plurality of refracting prisms 17. In addition to these effects, due to the existence of the flat portions 31 on the underside surface 34*b* of the optical member, a light distribution of light F emitted from the light source 12 through the flat portions 31 is superimposed on the light distribution of light emitted from the optical member 14. Therefore, by using this light F together with the primary light R1 and R2 as the illumination light, the illuminating apparatus 30 can more flexibly adapt to various demands for light distribution characteristics of an illuminating apparatus. According to the illuminating apparatus 30, these kinds of light distribution characteristics can be economically and easily realized with the single optical member 34.

The illuminating apparatus 30 can be suitably used as, for example, an illuminating apparatus that is attached to a ceiling with the optical axis C2 direction as the vertical direction and illuminates a wall surface with the primary light R1, R2, and R3 and illuminates a floor surface with the light F.

In FIG. 10, the illuminating apparatus 30 is illustrated with a plurality of flat portions 31. However, in the illuminating apparatus 10, as long as a flat portion 31 is provided between at least one prism 15, 17 among the plurality of prisms 15 and 17 and at least one prism 15, 17 that is adjacent to the above-mentioned prism 15, 17, the above-described effects can be achieved.

Preferably, the flat portions 31 are provided substantially symmetrically relative to the optical axis C2. Thereby, the light distribution of the light F becomes symmetrical with the optical axis at the center. This is an advantageous characteristic for, for example, adapting to the specifications of general floor illumination.

In the illuminating apparatus 30, the plurality of prisms 15 and 17 can be also provided on the emitting surface 34*b* of the optical member 34.

The present invention was explained above based on preferred embodiments thereof. However, the illuminating apparatus according to the present invention is not limited to the above embodiments.

For example, in the illuminating apparatus according to the present invention, some of the plurality of prisms (for example, the reflecting prisms) can be provided on the underside surface of the optical member while the remaining prisms (for example, the refracting prisms) can be provided on the emitting surface of the optical member.

Further, in the illuminating apparatus according to the present invention, a plurality of light scattering elements formed in, for example, a dome shape can be provided on a principal surface of the optical member on the side on which the plurality of prisms are not provided, or in a region of the principle surface of the optical member in which the plurality of prisms are not disposed.

What is claimed is:

1. An illuminating apparatus comprising:

a light source; and an optical member that faces the light source and controls light distribution of light emitted from the light source, wherein the optical member has a pair of principal surfaces, and a plurality of prisms extending in one direction are provided on at least one of the pair of principal surfaces, the plurality of prisms including:

a plurality of reflecting prisms that are provided in a first region among two regions divided at a virtual plane including a reference axis, the reflecting prisms being configured to emit light entered while reflecting the light at a reflecting surface; and a plurality of refracting prisms that are provided in a second region among the two regions, the refracting prisms being configured to emit light entered while refracting the light at a refracting surface.

2. The illuminating apparatus according to claim 1, wherein the plurality of reflecting prisms and the plurality of refracting prisms are overall configured to emit light entered by inclining the light in one direction relative to an optical axis of the light source.

3. The illuminating apparatus according to claim 1, wherein the refracting prisms are configured so that the refracting surfaces face the reference axis, and the reflecting prisms are configured so that the reflecting surfaces face the opposite side of the reference axis.

4. The illuminating apparatus according to claim 1, wherein the second region includes a region in which a plurality of the refracting prisms which are configured so that inclination angles of the refracting surfaces decrease as moving away from the reference axis are disposed.

5. The illuminating apparatus according to claim 1, wherein the light source is disposed so that its optical axis is included in the second region.

6. The illuminating apparatus according to claim 1, wherein the plurality of prisms are provided on a principal surface of the optical member on the opposite side of a principal surface that faces the light source.

7. The illuminating apparatus according to claim 1, wherein a flat portion is provided between at least one prism among the plurality of prisms and at least one prism that is adjacent thereto.

8. An optical member comprising:

a pair of principal surfaces, at least one of the pair of principal surfaces being configured to have a plurality of prisms extending in one direction, wherein the plurality of prisms includes:

a plurality of reflecting prisms that are provided in a first region among two regions divided at a virtual plane including a reference axis, the reflecting prisms being configured to emit light entered while reflecting the light at a reflecting surface; and a plurality of refracting prisms that are provided in a second region among the two regions, the refracting prisms being configured to emit light entered while refracting the light at a refracting surface.

* * * * *